US005327950A

United States Patent [19]

Combrink

[11] Patent Number: 5,327,950

[45] Date of Patent: Jul. 12, 1994

[54] APPARATUS FOR FILLING VALVED SACKS

[75] Inventor: Alois Combrink, Oelde, Fed. Rep. of Germany

[73] Assignee: Haver & Boecker, Oelde, Fed. Rep. of Germany

[21] Appl. No.: 134,966

[22] Filed: Oct. 12, 1993

[30] Foreign Application Priority Data

Oct. 21, 1992 [DE] Fed. Rep. of Germany ..... 4235469

[51] Int. Cl.[5] ..... B65B 1/04; B65B 3/04

[52] U.S. Cl. ..... 141/315; 141/68; 141/166; 53/570; 53/284.7

[58] Field of Search ..... 141/10, 68, 312, 313, 141/314, 315, 316, 346, 367, 368, 391, 392, 114, 166; 53/570, 571, 572, 573, 384.1, 284.7, 273, 274, 469, 473

[56] References Cited

U.S. PATENT DOCUMENTS 1,667,930 5/1928 Edmunds ..... 141/166
2,046,761 7/1936 Andreas ..... 141/68
2,156,224 4/1939 Neuman et al. ..... 141/312
2,523,673 9/1950 Austin ..... 141/166
3,118,474 1/1964 Eppolito ..... 141/68

*Primary Examiner*—Henry J. Recla
*Assistant Examiner*—Steven O. Douglas
*Attorney, Agent, or Firm*—Feiereisen & Kueffner

[57] ABSTRACT

Apparatus for filling valve sacks includes at least one filling pipe in fluid communication with a feed unit and receiving a valved sack. The filling pipe is provided with least one axial slot-like recess which is engageable by a clamping lever after a valve sack is placed over the outlet port of the filling pipe so as to apply a tension force onto the valve of the sack. In this manner, the valve of the sack is pushed into the recess and drawn against the outer surface of the filling pipe to attain a sealing action which is maintained even when pressure causes a widening of the valve because the clamping lever is then further lowered.

20 Claims, 2 Drawing Sheets

APPARATUS FOR FILLING VALVED SACKS

BACKGROUND OF THE INVENTION

The present invention refers to an apparatus for filling valved sacks, and in particular to a filling machine of the type having at least one filling pipe which is in fluid communication with a feed unit.

Filling machines for valved sacks come in various configurations e.g. as so-called rotary filling machines and stationary machines. In general, one end of the filling pipe constitutes the outlet port through which the material is discharged and introduced into the valved sack while the other end of the filling pipe is provided with a connection flange for attachment to the feed unit and for allowing a simple exchangeability thereof. In rotary filling machines, the filling pipes run either horizontal or vertical or are inclined relative to the horizontal by a small acute angle. Stationary filling machines can be designed in like manner if configured in form of a serial packaging machine.

Feed units for filling machines include e.g. rotatable feed turbines or pneumatically operated feed pots, called air packers. German patent DE-PS 3,607,508 describes a rotary filling machine for valved sacks which is equipped with an air packer and a feed turbine and can be combined with different types of filling pipes. In many cases, the use of double-walled filling pipes is preferred in order to enable a ventilation of the sacks during a filling operation. An exemplified double-walled filling pipe is disclosed e.g. in German patent DE-PS 3,834,810 which discloses also the arrangement of a reciprocating plunger for securing a valved sack being placed onto to filling pipe.

Common to these conventional filling machines for valved sacks is the drawback that air exiting from the sack carries with it material to be filled in the valved sack. This is true in particular when powdered materials are concerned. The escape of powdered particles or dust is annoying to the operator and results in an increased loss of material and thus in higher costs.

Several attempts were undertaken to avoid these drawbacks, none of which was able to satisfactorily solve the problem. One such attempt proposed a conical or double-cone configuration of the filing pipe. Even though such design improved the filling operation of valved sacks, the manufacture of valved sacks becomes more complicated and results in increased costs as the valve of the valved sack necessitates a complementary conical configuration.

In general, the attachment of a valved sack to the filling pipe should be possible in an easy manner without requiring any particular force or effort. For that reason, a play exists between the inner contour of the valve and the filling pipe. Since the presence of such a play actually promotes the escape of material, the conical design of the filling pipe was proposed in order to effectively act as a sealing element in the area of the valve. The conical configuration of the filling pipe allows a reduction in the amount of escaping material; however, a complete sealing is not ensured since the valve of the sack expands during the filling operation by the pressure of the material flowing into the valved sack. With the double-cone design of the filling pipe, the amount of escaping material could further be reduced, however, the increasing need for a dust-free and clean filling operation could still not be met. Moreover, it is unavoidable in the production of valved sacks that the generally tubular valves lie outside admissable tolerances. This further complicates the possibility of reaching a dust-free and clean filling operation.

Other solutions for reducing an escape of dust particles encompass filling pipes with expandable packing, or split filling pipes which open up in a jaw-like or beak-like manner. In the latter case, passages are however created after opening of both parts of the filling pipes through which material can escape. Moreover, outgoing air cannot be guided in a closed system.

It was further proposed to design the filling pipe at least in the central area thereof as an expandable tube. Apart from the fact that such an expandable tube constitutes a wearing part, the attachment of valved sacks is complicated because the slidability of the tube relative to the normal filling pipes is disadvantageous.

In accordance with another proposal, the valve of the valved sacks is designed in form of a filter valve made of air-permeable material through which outgoing air is aspirated. Also this solution does not satisfactorily solve the problem of widening of the valve during filling operation.

German patent DE-PS 580,335 discloses a feed nozzle which is flattened at the upper side either over the entire length of the nozzle or over the forward area thereof. Instead of being flattened, the feed nozzle may also be provided in the central area with a transverse indentation. Cooperating with the feed nozzle is a sack holder which is swingably mounted to press the sack against the feed nozzle during filling operation. In order to increase the friction, the flattened area of the filling pipe is roughened, with the complimentary side of the sack holder being roughened as well. Instead of roughening, the filling pipe may also be provided at a central area thereof with a step or an indentation so that the sack becomes deformed by the sack holder. This publication is silent in regard with an escape of material and with the structure of a filling machine to allow filling material to pass through the feed nozzle into the sack. Moreover, the provision of a transverse step or indentation is insufficient to attain a sufficient sealing; rather, passages are created through which material can escape.

SUMMARY OF THE INVENTION

It is an object of the present invention to provide an improved filling apparatus for valved sacks, obviating the aforestated drawbacks.

In particular, it is an object of the present invention to provide an improved filling apparatus for valved sacks which prevents material form escaping and achieves a clean and dust-free filling operation.

These objects and others which will become apparent hereinafter are attained in accordance with the present invention by providing the filling pipe with at least one slot-like axial recess which is engageable by a clamping lever swingably mounted relative to the filling pipe and actuated by a controllable drive so that the valved sack which is placed over the filling pipe is tensed and stretched by the lowered clamping lever to thereby circumferentially enclose along its entire length the outer surface of the filing pipe.

In accordance with the present invention, the valve bottom of the valved sack being placed over the filling pipe forms an abutment for the clamping lever which is depressed into the recess. Thus, the section of the valve which bridges the recess is subjected to external tension forces exerted from the clamping lever so that the valve is drawn closely to the outer surface of the filling pipe around the recess. Since the valve is made within certain tolerances, it may occur that the valve does not completely cover the length of the recess so that only part of the valve is subjected to the tension forces. However, this part of the valve is sufficiently long to enable a proper sealing engagement in the valve area so as to prevent material form escaping. Even when the valve is subjected to pressure during the filling operation and thus widens, the inner surface of the valve is drawn against the filling pipe since the clamping lever is pressed by the drive unit by a constant force and thus is respectively lowered in correspondence with the expansion of the valve.

The design of the filling machine according to the present invention permits a wide tolerance between the valve and the filling pipe so that the attachment of the valved sack to the filling pipe is considerably facilitated.

In an embodiment of the filling machine with a double-walled filling pipe, the separation of the outer annular vent channel from the inner material channel is completely maintained so that the separation between the outgoing air and the flow of filling material is retained.

In accordance with another feature of the present invention, the slot-like recess extends from the outlet port of the filling pipe to a central area thereof so that outgoing air can easily flow into the vent channel. The length of this sealing area is sufficient for sealing double-walled or single-walled filling pipes. This is also true in those cases in which due to the tolerances in the manufacture of sacks, the valve does not stretch over the entire length of the slot-like recess so that the clamping lever may bear against an area of the forward or rearward end of the recess.

The effectiveness of the clamping lever is significantly improved when allowing its pivot axis to align within a given range between successive filling operations so that at different valve widths the lowering clamping lever contacts the valve bottom in the area of the end of the recess and self-adjusts to tense the valve essentially over its entire length. In this manner, pressure points are created at least in the area of the forward and rearward ends of the recess.

Advantageously, the pivot axis is formed by a bolt of the clamping lever which bolt is guided in at least one slot of a stationary support. Suitably, the clamping lever is a one-armed lever which is swingably mounted at one end in the area of one end of the recess and is acted upon at its other end by the controllable drive unit, with the clamping lever being bent in a central area thereof at an angle of below 180°, for example 170°.Thus, the effective area of the clamping lever in the lowered position is in parallel or approximately parallel relationship to the center axis of the filling pipe so that the valve is tensed essentially over its entire length.

The configuration of the recess in form of a longitudinal slot is preferred since the movement of the clamping lever is not restricted in direction to the center axis of the filling pipe. Also in double-walled filling pipes, the downwardly open design of the recess ensures a separate transport of the filling material and the outgoing air since those parts of the sack which engage the recess will not interfere with the material flow. Moreover, the parallel relationship between the filling pipe and the clamping lever allows the valve to completely enclose the area of the ventilation bores so that extraneous air is prevented from being aspirated through the proximal valve end.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
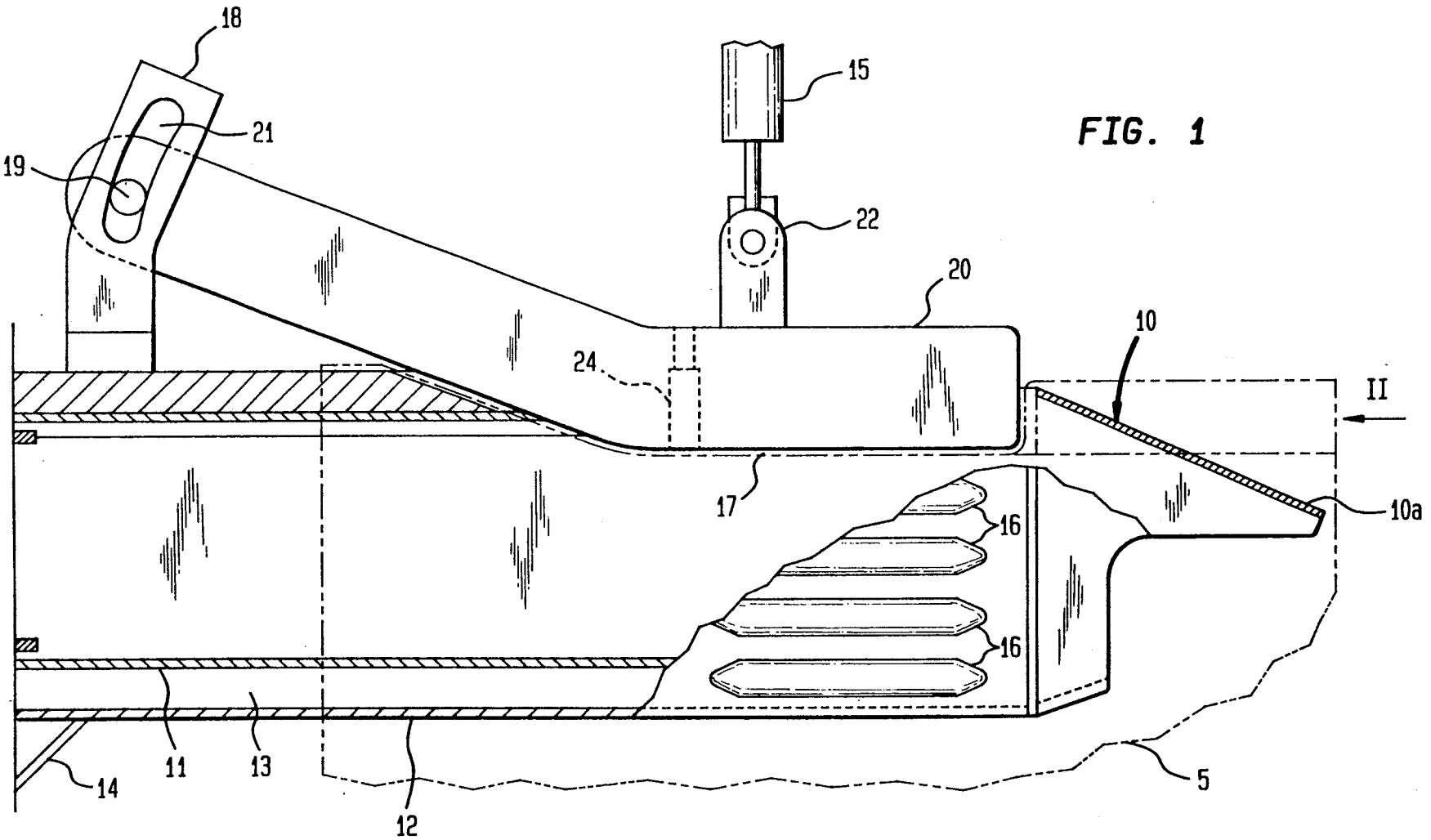
FIG. 1 is a partly longitudinal section of one embodiment of a filling apparatus for a valved sack according to the present invention.

Throughout all the Figures, the same or corresponding elements are always indicated by the same reference numerals.

Referring now to the drawing and in particular to FIG. 1, there is shown a partly longitudinal section of one embodiment of a filling apparatus for a valved sack which is indicated in dashdot line and designated by reference numeral 5. The filling apparatus includes a double-walled filling pipe, generally designated by reference numeral 10 and including an inner tube 11 of generally annular cross section and an outer tube 12 of polygonal cross section. The outer tube 12 and the inner tube 11 define a vent channel 13 which communicates via a draft tube 14 with a vacuum source (not shown).

As shown in FIG. 1, the valve sack 5 is placed over a cup-shaped end piece 10*a* and the forward end (outlet port) of the filling pipe 10. In the forward area, the filling pipe 10 includes several oblong bores 16 which extend in longitudinal direction and are spaced about the circumference of the filling pipe 10. The oblong bores 16 are in communication with the vent channel 13 to allow outgoing air to flow through the oblong bores 16 into the vent channel 13.

Although not shown in detail in the drawing, the filling pipe 10 is suitably provided at its other axial end with a connection flange for attachment to a not shown feed unit such as a feed turbine.

Figure 2:
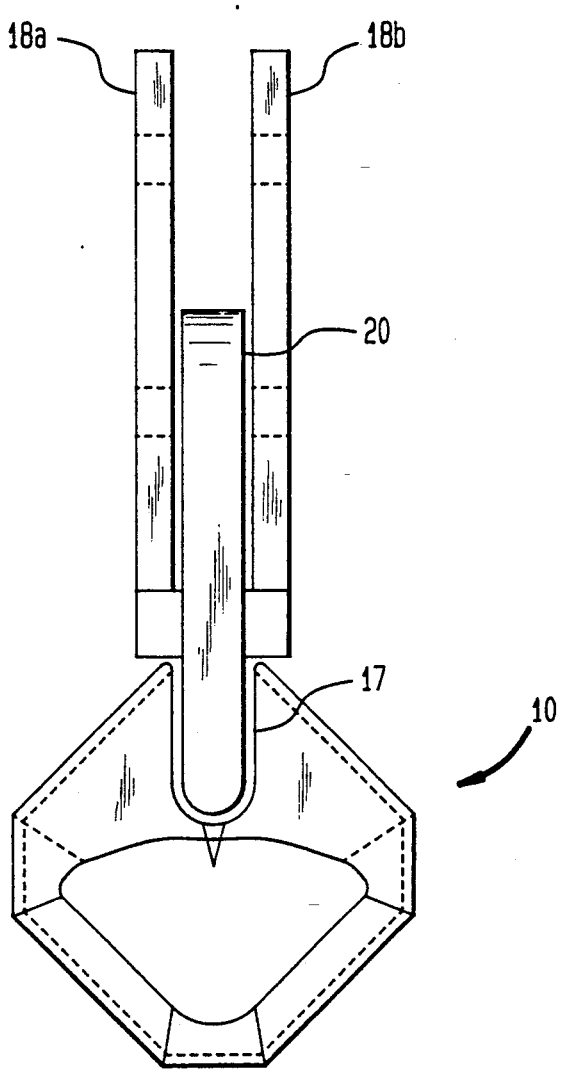
FIG. 2 is a plan view in direction of arrow II in FIG. 1.

As best seen in FIG. 2, which is a plan view in direction of arrow II in FIG. 1, the filling pipe 10 is provided at an upper section thereof with an axial slot-like recess 17 which extends radially through the inner tube 11 and the outer tube 12 and, as shown in FIG. 1, extends essentially from the outlet port to a central area of the filling pipe 10.

At an axial distance from the recess 17 is a knee-shaped stationary support 18 which is fixedly secured to the outer tube 12 of the filling pipe 10. The support 18 is configured in form of a fork head (FIG. 2) with two spaced parallel legs 18*a*, 18*b*, each including an arched slot 21 for guiding a bolt 19 of a clamping lever 20. In this manner, the clamping lever 20 is swingably mounted at the end distant to the outlet port of the filling pipe 10. As shown in FIG. 1, the clamping lever 20 is a one-armed lever which is bent in a central area at an angle smaller than 180°, e.g. 170°. Suitably, the center of curvature of the arched slots 21 is selected such as to coincide with the area of the bend.

In proximity of the bend of the clamping lever 20 is a mount 22. Hingedly connected to the mount 22 is the piston rod of a piston/cylinder unit 15 which forms a controlled drive for the clamping lever 20. The piston/- cylinder unit 15 is attached in a manner not shown per se to brackets of the filling apparatus.

Suitably, a sensor 24 is provided to detect the presence of a valved sack 5 and to trigger a filling operation.

At operation, the clamping lever 20 is positioned to allow attachment of an empty valved sack 5 over the end piece 10*a* and the outlet port of the filling pipe 10 and beneath the clamping lever 20. As shown in FIG. 1, the sack 5 is suitably slipped over the filling pipe 10 to an area behind the recess 17. Actuation of the piston/-cylinder unit 15 lowers the clamping lever 20 into the slot-like recess 17 so that the portion of the valved sack 5 covering the recess 17 is pushed downwards into the recess 17 to thereby draw the valve tightly against the outer surface of the filling pipe 10.

The angled configuration of the clamping lever 20 together with the arched slots 21 allows a self-adjustment of the clamping lever 20 during actuation by the piston/cylinder unit 15 so that the valve of the sack is tensed essentially over its entire length by the lowered clamping lever 20.

By swingably supporting the clamping lever 20 about a pivot axis in form of the bolt 19, the distance of the pivot axis from the filling pipe 10 can be modified between successive filling operations in order to enable the clamping lever 20 to tense valved sacks of different widths over the length of the recess 17. In this manner a sealing engagement is also attained in the area of the oblong bores 16 and thus essentially over the length of the valve. Moreover, the recess 17 is sealed at the outlet port distant end thereof so that material is prevented from escaping in this area.

Under normal conditions, the use of conventional sack holders is not required so that the valved sack filling apparatus according to the present invention can be operated in a very economical manner.

Persons skilled in the art will understand that the recess may also be substituted by an inwardly formed bead which may also reach the inner tube 11. Moreover, the filling apparatus is shown by way of example only, and may also be applicable in connection with a vertical downpipe, with the recess 17 extending along the respective area of the filling pipe which is attached to the downpipe.

It will also be appreciated by persons skilled in the art that the filling pipe 10 may also be provided with two slot-like recesses which then respectively cooperate with two clamping levers 20. In such an embodiment, the recesses 17 are situated, relative to the circumference of the filling pipe 10, at a relatively small angular distance. This embodiment is advantageous with filling pipes of smaller diameter.

The provision of a recess 17 according to the present invention enables also greater tolerances between the filling pipe 10 and the valve of the sack.

While the invention has been illustrated and described as embodied in an apparatus for filling valved sacks, it is not intended to be limited to the details shown since various modifications and structural changes may be made without departing in any way from the spirit of the present invention.

What is claimed as new and desired to be protected by Letters Patent is set forth in the appended claims:

I claim:

1. Apparatus for filling a valved sack, comprising:

at least one filling pipe in fluid communication with a feed unit and having one end for receiving the valve of a valved sack, said filling pipe defining a filling axis and including at least one elongated slot-like recess extending in the axial direction defined by said filling axis over a defined area; and clamping means movably mounted relative to said filling pipe for engagement in said recess and application of a tension force onto the valve of the valved sack during a filling operation so as to tense and enable the valve to closely bear along its entire length against the outer surface of said filling pipe.

2. Apparatus as defined in claim 1 wherein said recess is an elongated slot.

3. Apparatus as defined in claim 1 wherein said filling pipe is a double-walled filling pipe with an outer pipe and an inner pipe, said recess being a bead formed inwardly into said outer pipe.

4. Apparatus as defined in claim 1 wherein said recess extends from said forward end to a central area of said filling pipe.

5. Apparatus as defined in claim 1 wherein said clamping means includes a clamping lever having one end engaging said recess and another end movably supported about a pivot axis so as to be adjustable within a predetermined range to the width of a valve and to enable a sealing of the valve at least in the area of the one end of said clamping lever as well as a sealing of the recess in the opposite end area which faces said pivot axis.

6. Apparatus as defined in claim 5 wherein said clamping means includes a support mounted to said filling pipe and having a slot, and a bolt mounted to said one end of said clamping lever and engaging said slot to define said pivot axis.

7. Apparatus as defined in claim 6 wherein said support is a fork head spaced from said recess and defining two parallel legs, each having a slot.

8. Apparatus as defined in claim 6 wherein said clamping means further includes a drive unit acting upon said one end of said clamping lever, said slot being of arched configuration and having a center of curvature situated in a connection area of said drive unit with said clamping lever.

9. Apparatus as defined in claim 8 wherein said clamping lever is a one-armed lever having a central area which is bent at an angle of slightly below 180°.

10. Apparatus as defined in claim 5 wherein said drive unit is a piston/cylinder unit.

11. Apparatus as defined in claim 5 wherein said filling pipe has two such recesses, with each recess being engageable by a clamping lever.

12.Apparatus as defined in claim 5 wherein said drive unit includes two single drives.

13. Apparatus as defined in claim 12 wherein said drive unit includes two piston/cylinder units.

14. In a filling apparatus of the type having a filling pipe for receiving a valved sack, a clamping device for sealing engagement of the valve of the valved sack upon the outer surface of the filling pipe comprising:

a clamping lever having one end engageable in an elongated recess extending in the axial direction defined by the filling axis of said filling pipe of the filling pipe after a valved sack is placed over an outlet port of the filling pipe; and a drive unit acting upon said one end of said clamping lever for applying a tension force in direction of the valved sack to push the valve into the recess and thereby allow the valve to closely bear over its entire length against the outer surface of the filling pipe.

15. The apparatus defined in claim 14 wherein said recess extends from the outlet port to a central area of said filling pipe.

16. The apparatus as defined in claim 14 wherein said clamping lever has another end swingably supported about a pivot axis so as to be adjustable to the Width of a valve and to enable a sealing of the valve at least in the area of the one end of said clamping lever as well as a sealing of the recess in the opposite end area which faces said pivot axis.

17. Apparatus as defined in claim 16, and further comprising a support mounted to said filling pipe and having a slot, said clamping lever being provided with a bolt forming said pivot axis and engaging said slot.

18. Apparatus as defined in claim 17 wherein said support is a fork head having two parallel legs, each having a slot for engagement by said bolt.

19. Apparatus as defined in claim 17 wherein said slot is of arched configuration and has a center of curvature situated in a connection area of said drive unit with said clamping lever.

20. Apparatus as defined in claim 14 wherein said clamping lever is a one-armed lever having a central area bent at an angle of slightly below 180°.

* * * * *